United States Patent [19]

Evans et al.

[11] Patent Number: 4,657,664

[45] Date of Patent: Apr. 14, 1987

[54] PROCESS FOR DEMETALLATION AND DESULFURIZATION OF HEAVY HYDROCARBONS

[75] Inventors: April J. Evans, Naperville, Ill.; Albert L. Hensley, Munster, Ind.

[73] Assignee: Amoco Corporation, Chicago, Ill.

[21] Appl. No.: 811,492

[22] Filed: Dec. 20, 1985

[51] Int. Cl.[4] ..... C10G 45/00; C10G 45/60

[52] U.S. Cl. ..... 208/211; 208/216 PP; 208/251 H; 208/112; 208/127; 208/59

[58] Field of Search ..... 208/216 PP, 251 H, 112, 208/127, 59

[56] References Cited

U.S. PATENT DOCUMENTS

| | | | |
|---|---|---|---|
| 3,360,456 | 12/1967 | Kosiba et al. | 208/112 |
| 3,418,234 | 12/1968 | Chervenak et al. | 208/59 |
| 3,640,817 | 2/1972 | O'Hara | 208/59 |
| 3,830,728 | 8/1974 | Mounce | 208/112 |
| 4,102,779 | 7/1978 | Hensley, Jr. | 208/251 H |
| 4,211,634 | 7/1980 | Berlolacini et al. | 208/59 |
| 4,212,729 | 7/1980 | Hensley, Jr. et al. | 208/216 PP |
| 4,297,242 | 10/1981 | Hensley, Jr. et al. | 208/216 PP |
| 4,344,840 | 8/1982 | Kunesn | 208/59 |
| 4,431,525 | 2/1984 | Hensley, Jr. et al. | 208/216 PP |
| 4,498,972 | 2/1985 | Toulhout et al. | 208/59 |
| 4,508,615 | 4/1985 | Oleck et al. | 208/216 PP |

*Primary Examiner*—John Doll
*Assistant Examiner*—Helane Myers
*Attorney, Agent, or Firm*—Ekkehard Schoettle; William H. Magidson; Ralph C. Medhurst

[57] ABSTRACT

Disclosed is an improved multi-stage process for the hydroconversion of heavy hydrocarbon feedstocks containing asphaltenes, metals and sulfur compounds. The process is characterized by the use of a relatively inexpensive demetallation catalyst in a first reaction zone comprising a Group VIB and/or a Group VIII metal deposed on a high macropore volume inorganic support followed by the use of a desulfurization catalyst in a second reaction zone comprising a Group VIB and a Group VIII metal on a high macropore volume inorganic oxide support.

14 Claims, 3 Drawing Figures

PROCESS FOR DEMETALLATION AND DESULFURIZATION OF HEAVY HYDROCARBONS

BACKGROUND

This invention relates to a catalytic process for the hydroconversion of heavy hydrocarbon streams containing asphaltenic material, metals, and sulfur compounds. More particularly, this invention relates to hydroconversion using multiple-stage catalytic treatment with catalysts having improved effectiveness and activity maintenance in the desulfurization of metal-containing hydrocarbon streams.

As refiners increase the proportion of heavier, poorer quality crude oil in the feedstock to be processed, the need grows for processes to treat the fractions containing increasingly higher levels of metals, asphaltenes, and sulfur.

It is widely known that various organometallic compounds and asphaltenes are present in petroleum crude oils and other heavy petroleum hydrocarbon streams, such as petroleum hydrocarbon residua, hydrocarbon streams derived from tar sands, and hydrocarbon streams derived from coals. The most common metals found in such hydrocarbon streams are nickel, vanadium, and iron. Such metals are very harmful to various petroleum refining operations, such as hydrocracking, hydrodesulfurization, and catalytic cracking. The metals and asphaltenes cause interstitial plugging of the catalyst bed and reduced catalyst life. The various metal deposits on a catalyst tend to poison or deactivate the catalyst. Moreover, the asphaltenes tend to reduce the susceptibility of the hydrocarbons to desulfurization. If a catalyst, such as a desulfurization catalyst or a fluidized cracking catalyst, is exposed to a hydrocarbon fraction that contains metals and asphaltenes, the catalyst will become deactivated rapidly and will be subject to premature replacement.

Although processes for the hydroconversion of heavy hydrocarbon streams, including but not limited to heavy crudes, reduced crudes, and petroleum hydrocarbon residua, are known, the use of fixed-bed catalytic processes to convert such feedstocks without appreciable asphaltene precipitation and reactor plugging and with effective removal of metals and other contaminants, such as sulfur compounds and nitrogen compounds, are not common because the catalysts employed have not generally been capable of maintaining activity and performance.

Thus, the subject hydroconversion processes are most effectively carried out in an ebullated bed system. In an ebullated bed, preheated hydrogen and resid enter the bottom of a reactor wherein the upward flow of resid plus an internal recycle suspend the catalyst particles in the liquid phase. Recent developments involved the use of a powdered catalyst which can be suspended without the need for a liquid recycle. In this system, part of the catalyst is continuously removed in a series of cyclones and fresh catalyst is added to maintain activity. Roughly about 1 wt. % of the catalyst inventory is replaced each day in an ebullated bed system. Thus, the overall system activity is the weighted average activity of catalyst varying from fresh to very old i.e., deactivated.

Hopkins et al., in U.S. Pat. No. 4,119,531, disclose a process for hydrodemetallation of hydrocarbon streams containing asphaltenes and a substantial amount of metals, which comprises contacting the hydrocarbon stream with a catalyst consisting essentially of a small amount of a single hydrogenation metal from Group VIB or Group VIII, deposed on a large pore alumina; suitable examples of the hydrogenation metal are nickel or molybdenum. The catalyst is characterized by a surface area of at least 120 $m^2/gm$; a pore volume of at least 0.7 cc/gm and an average pore diameter of at least 125 Å units.

Hensley et al., in U.S. Pat. No. 4,297,242, disclose a multiple-stage catalytic process for hydrodemetallation and hydrodesulfurization of heavy hydrocarbon streams containing asphaltenes and a substantial amount of metals. The first stage of this process comprises contacting the feedstock in a first reaction zone with hydrogen and a demetallation catalyst comprising hydrogenation metal selected from Group VIB and/or Group VIII deposed on a large-pore, high surface area inorganic oxide support; the second stage of the process comprises contacting the effluent from the first reaction zone with a catalyst consisting essentially of hydrogenation metal selected from Group VIB deposed on a smaller pore, catalytically active support comprising alumina, said second stage catalyst having a surface area within the range of about 150 $m^2/gm$ to about 300 $m^2/gm$, an average pore diameter within the range of about 90 Å to about 160 Å, and a pore volume within the range of about 0.4 cc/gm to about 0.9 cc/gm. Hensley et al. disclose that as little as 2.2 wt. % cobalt oxide caused more rapid deactivation of their second-stage catalyst for sulfur removal.

In U.S. Pat. No. 4,212,729 to Hensley et al., another two-stage catalytic process for hydrodemetallation and hydrodesulfurization of heavy hydrocarbon streams containing asphaltenes and metals is disclosed. In this process, the first-stage demetallation catalyst comprises a metal selected from Group VIB and from Group VIII deposed on a large-pore, high surface area inorganic oxide support. The second stage catalyst contains a hydrogenation metal selected from Group VIB deposed on a smaller pore catalytically active support having the majority of its pore volume in pore diameters within the range of about 80 Å to about 130 Å.

Other examples of multiple-stage catalytic processes for hydrotreatment of heavy hydrocarbon streams containing metals are disclosed in U.S. Pat. Nos. 3,180,820 (Gleim et al., 1965); 3,730,879 (Christman, 1973); 3,977,961 (Hamner, 1976); 3,985,684 (Arey, et al., 1977); 4,016,067 (Fischer, 1977); 4,054,508 (Milstein, 1977); 4,051,021 (Hamner, 1977); and 4,073,718 (Hamner, 1978).

The catalysts disclosed in these references contain hydrogenating components comprising one or more metals from Group VIB and/or Group VIII on high surface area support such as alumina, and such combinations of metals as cobalt and molybdenum, nickel and molybdenum, nickel and tungsten, and cobalt, nickel, and molybdenum have been found useful. Generally, cobalt and molybdenum have been preferred metals in the catalysts disclosed for hydrotreatment of heavy hydrocarbon streams, both in first-stage catalytic treatment to primarily remove the bulk of the metal contaminants, and in second-stage catalytic treatment primarily for desulfurization.

A difficulty which arises in resid hydroconversion units employing the above catalyst systems is the formation of insoluble carbonaceous substances also known as Shell hot filtration solids. These substances cause operability problems in the hydroconversion units. Certain resids tend to produce greater amounts of solids thereby limiting the level of upgrading by the amount of these solids the hydroprocessing unit can tolerate.

Further, the higher the conversion level for given feedstocks, the greater the amount of solids formed. In high concentrations, these solids accumulate in lines and separators, causing fouling, and in some cases interruption or loss of process flow.

Accordingly, it is a general object of this invention to provide a process affording a higher conversion level for heavy hydrocarbon feedstocks that tend to form greater amounts of insoluble substances, especially that fraction of the feedstock that boils over 1,000° F.

It is another object of the present invention to provide a process that can tolerate larger amounts of insoluble carbonaceous substance producing feedstocks in the feed stream to the process.

It is yet another object of the present invention to provide a process that employs a less expensive catalyst system than conventional processes designed to handle heavy hydrocarbon feed streams.

These objectives can be attained by the process of the present invention involving a multi-stage process for hydrodemetallation, hydrodesulfurization, and conversion of a hydrocarbon feedstock containing asphaltenes and a substantial amount of metals. The process of the present invention differs from the above-cited demetallation-de sulfurization processes in that the desulfurization catalyst employed in the process of the invention contains macropores such that the pore volume of pores having a diameter larger than 1,200 Å ranges from about 0.1 to about 0.25 cc/gm. This is in marked contradistinction to the desulfurization catalysts disclosed in U.S. Pat. Nos. 4,212,729 and 4,297,242 wherein less than 15% of the total pore volume resides in pores having diameters above 130 Å. Further, the process of the present invention also requires the presence of a Group VIII metal in addition a Group VIB metal in the desulfurization catalyst in contradistinction to U.S. Pat. Nos. 4,212,729 and 4,297,242 which limit the active hydrogenation metal in the desulfurization catalyst to one selected from Group VIB metals.

Additionally, while the desulfurization catalyst used in the process of the invention has the subject macropore volume suitable for demetallation of the feedstock it is a relatively expensive catalyst since it contains relatively large amounts of Group VIB and Group VIII metals. The process of the present invention supplants a portion of the desulfurization catalyst with a relatively less expensive demetallation catalyst containing the requisite macropore volume for demetallation, but a lower amount of hydrogenation metals. The overall system is then relatively less expensive than using only the desulfurization catalyst to effect both demetallation and desulfurization.

This feature of the invention is illustrated in the following manner. If one assumes that the hydrodemetallation process adheres to a first-order kinetics model and that there is an overall metals removal by the catalyst of 95%, one obtains a characteristic distribution of metals in the catalyst bed. This distribution is such that the first third of a catalyst bed would have 65.7% of the total amount of metals removed from an influent stream, the middle third would have 24.7%, and the last third would have only 9.5% of the metals. Thus, if one uses a catalyst that has the capacity to hold 60% of its weight in metals, the first third would hold 60 wt. % metals, the second third would hold 22.6 wt. % metals while the last third would hold only 8.6% metals, far below the catalyst's 60 wt. % capacity. The entire system would have to be shut down prior to the last two-thirds of the bed reaching their capacity for demetallation. However, if only the first third of the catalyst bed is supplanted with a high capacity demetallation catalyst having a capacity to hold 100% of its weight in metals, the second third will then hold 37.6% of its weight in metals and the last third 14.4%. Thus, by placing a high capacity catalyst in the first bed only, the overall average capacity increases from 30% of all of the catalyst's weight in metals holding capacity to 50.6%. Or, the overall life of the system is increased by 68% prior to shut down.

Also, while providing a less expensive overall catalyst system, the process of the present invention provides a catalyst system that can handle feeds that produce large amounts of insoluble carbonaceous substances or alternatively effect a high conversion level for feedstocks that produce relatively less insoluble carbonaceous substances because both catalysts in the invention system posses the requisite macropore volume instrumental in reducing the formation of insoluble carbonaceous substances.

SUMMARY OF THE INVENTION

This invention comprises a multi-stage process for hydrodemetallation, hydrodesulfurization, and hydroconversion of a hydrocarbon feedstock containing asphaltenes and a substantial amount of metals. In the first reaction zone of the multi-stage process, the hydrocarbon feedstock is contacted with hydrogen and a demetallation catalyst comprising a hydrogenation component selected from Group VIB metals deposed on a high-surface area porous, large pore, inorganic oxide support.

The Group VIB metals are present in amounts that range from about 3.0 to about 8.0 wt. % calculated as an oxide and based on total demetallation catalyst weight. In a preferred embodiment, the demetallation catalyst also contains a Group VIII metal which is present in an amount that ranges from about 0.4 to about 2.0 wt. % of the Group VIII metal calculated as the oxide based on total demetallation catalyst weight. The demetallation catalyst has a surface area of about 150 $m^2$/gm to about 220 $m^2$/gm, and a total pore volume within the range of about 0.85 cc/gm to about 1.5 cc/gm. Further, the pore volume of pores possessing diameters greater than about 1,200 Å ranges from about 0.15 cc/gm to about 0.4 cc/gm. This demetallation catalyst contains a considerably lower amount of metals than the desulfurization catalyst used in the second reaction zone and hence is less expensive. It is believed the large pores in the demetallation catalyst afford surface area accessibility to the large asphaltenic molecules that are implicated in the formation of insoluble carbonaceous substance. Additionally, metals present in the feedstock such as vanadium and nickel are deposited in these large pores thereby preventing poisoning of the very active desulfurization catalyst present in the second reaction zone.

In the second reaction zone of the multi-stage process the effluent from the first reaction zone is contacted with hydrogen and a desulfurization catalyst comprising a hydrogenation component comprising Group VIB and Group VIII metals deposed on a porous inorganic oxide support. The desulfurization catalyst has a surface area within the range of about 250 $m^2/gm$ to about 350 $m^2/gm$, a total pore volume within the range of about 0.7 cc/gm to about 1.1 cc/gm.

The desulfurization catalyst is further characterized by having a pore volume varying from about 0.1 to about 0.25 cc/gm in pores larger than 1,200 Å. Again it is believed that these large pores afford accessible surface area to facilitate conversion of large asphaltene molecules.

The process of the invention converts at least 30 vol. % of the hydrocarbon fraction boiling above 1,000° F. to material boiling below 1,000° F., and preferably 70 vol. % of the fraction boiling over 1,000° F. to material boiling below 1,000° F.

DETAILED DESCRIPTION OF THE INVENTION

Figure 1:
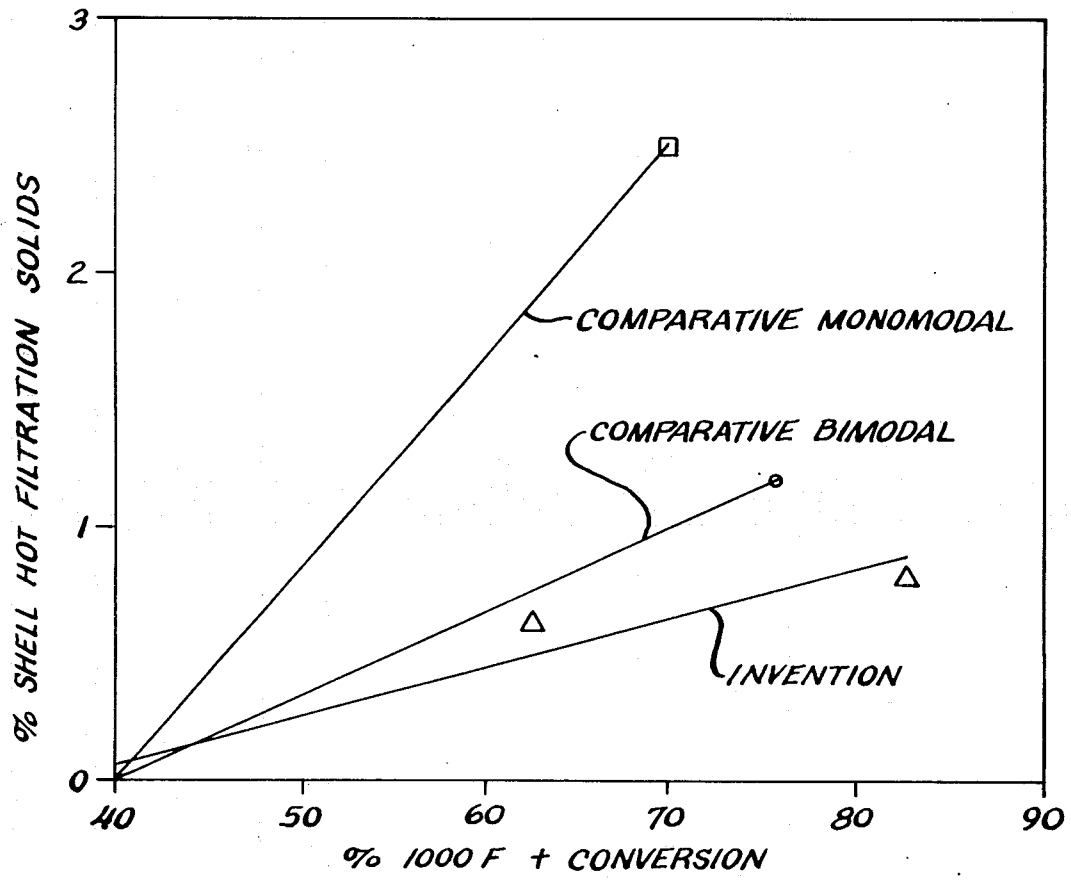
FIG. 1 illustrates the advantage in operability offered by the invention as compared to a prior art twostage process, the comparative monomodal process, and a process using only a desulfurization catalyst, the comparative bimodal process.

Broadly, the present invention is directed to a process for the hydroconversion of heavy hydrocarbon feedstocks which contain asphaltenes, metals, nitrogen compounds, and sulfur compounds. As is well-known these feedstocks contain nickel, vanadium, and asphaltenes, e.g., about 40 ppm up to more than 1,000 ppm for the combined total amount of nickel and vanadium and up to about 25 wt. % asphaltenes. A unit processing 60,000 barrels of resid per stream day is capable of producing 10% of U.S. vanadium needs per year. Further, the economics of the process of the invention are dependent upon producing a fully demetallized residual by-product, which can be used to make anode grade coke. This process is particularly useful in treating feedstocks with a substantial amount of metals containing 150 ppm or more of nickel and vanadium and having a sulfur content in the range of about 1 wt. % to about 10 wt. %. Typical feedstocks that can be treated satisfactorily by the process of the present invention contain a substantial amount of components that boil appreciably above 1,000° F. Examples of typical feedstocks are crude oils, topped crude oils, petroleum hydrocarbon residua, both atmospheric and vacuum residua, oils obtained from tar sands and residua derived from tar sand oil, and hydrocarbon streams derived from coal. Such hydrocarbon streams contain organometallic contaminants which create deleterious effects in various refining processes that employ catalysts in the conversion of the particular hydrocarbon stream being treated. The metallic contaminants that are found in such feedstocks include, but are not limited to, iron, vanadium, and nickel.

Nickel is present in the form of soluble organometallic compounds in most crude oils and residuum fractions. The presence of nickel porphyrin complexes and other nickel organometallic complexes causes severe difficulties in the refining and utilization of heavy hydrocarbon fractions, even if the concentration of such complexes is relatively small. It is known that a cracking catalyst deteriorates rapidly and its selectivity changes when in the presence of an appreciable quantity of the organometallic nickel compounds. An appreciable quantity of such organometallic nickel compounds in feedstocks that are being hydrotreated or hydrocracked harmfully affects such processes. The catalyst becomes deactivated and plugging or increasing of the pressure drop in a fixed-bed reactor results from the deposition of nickel compounds in the interstices between catalyst particles.

Iron-containing compounds and vanadium-containing compounds are present in practically all crude oils that are associated with the high Conradson carbon asphaltenic and/or asphaltenic portion of the crude. Of course, such metals are concentrated in the residual bottoms, when a crude is topped to remove those fractions that boil below about 450° F. to 600° F. If such residuum is treated by additional processes, the presence of such metals adversely affects the catalyst in such processes. It should be pointed out that the nickel-containing compounds deleteriously affect cracking catalysts to a greater extent than do iron-containing compounds. If an oil containing such metals is used as a fuel, the metals will cause poor fuel oil performance in industrial furnaces since they corrode the metal surfaces of the furnaces.

While metallic contaminants, such as vanadium, nickel, and iron, are often present in various hydrocarbon streams, other metals are also present in a particular hydrocarbon stream. Such metals exist as the oxides or sulfides of the particular metal, or as a soluble salt of the particular metal, or as high molecular weight organometallic compounds, including metal naphthenates and metal porphyrins, and derivatives thereof.

Another problem associated with hydroconversion of heavy hydrocarbons is the formation of insoluble carbonaceous substances from the asphaltenic fraction of the feedstock which cause operability problems. The amount of such insolubles formed increases with the amount of material boiling over 1,000° F. which is converted or with an increase in the reaction temperature employed. These insoluble substances, also known as Shell hot filtration solids, create the operability difficulties for the hydrotreating unit and thereby circumscribe the temperatures and feeds the unit can handle. In other words, the amount of solids formed limit the conversion of a given feedstock. Operability difficulties as described above begin to manifest themselves when the solids levels reach about the 1.0 to 1.3 wt. % level. Levels below 1.0 wt. % are generally recommended to prevent fouling of process equipment. The Shell hot filtration procedure is set out in Van Kerkuoort, W. J. and Nieuwstad, A. J. J., Journal of the Inst. of Petroleum (1951) 37 596–604 and is incorporated herein by reference.

Although the present invention is in no way limited to the following speculative mechanism, it is believed that such insoluble carbonaceous substances are formed when the heavy hydrocarbons are converted in the hydroconversion unit thereby rendering them a poorer solvent for the unconverted asphaltenic fraction and hence creating the insoluble carbonaceous substances. The process of the present invention decreases the formation of the insolubles by having most of its surface area in the demetallation catalyst and in the desulfurization catalyst accessible by very large pores so that most of the catalyst surface is accessible to large asphaltenic molecules. Also, deposition of nickel and vanadium in the large pore demetallation catalyst serve to decrease deactivation of the very active downstream desulfurization catalyst, thereby maintaining higher asphaltenes conversion in the desulfurization catalyst which similarly contains a large macropore volume.

The process of the present invention serves to reduce Shell hot filtration solids and thereby increase operability while simultaneously permitting the conversion of heavy hydrocarbons which are prone to produce large amounts of Shell hot filtration solids. An additional advantage of the present invention is the relatively low cost of the demetallation catalyst in comparison to the desulfurization catalyst thereby enhancing the overall economics of the process of the invention as compared to one using all desulfurization catalyst possessing macropore volume. This benefit arises in part from the reduced amount of hydrogenation metals used in the demetallation catalyst and from the longer life, i.e., stability of the demetallation catalyst.

Sequentially contacting the heavy hydrocarbon feedstock with the demetallation catalyst of this invention followed by the desulfurization catalyst of this invention allows hydrodemetallation and hydrodesulfurization with greatly extended overall system catalyst life even under severe conditions.

The demetallation catalyst and the desulfurization catalyst can be employed in a single reactor as a dual bed or the two catalysts can be employed in separate, sequential reactors, and various combinations of these two basic reactor schemes can be employed to achieve flexibility of operation and product upgrade. In commercial operation, either of the basic reactor schemes described can comprise multiple parallel beds of the catalyst. In any reactor scheme used in the process of this invention, the volume of demetallation catalyst ranges from 0.2 volumes to 0.6 volumes and the volume of desulfurization catalyst ranges from 0.4 volumes to 0.8 volumes.

The preferred system for the present invention comprises a series of ebullated bed reactors. In particular, a three-stage system wherein the first-stage ebullated bed contains the demetallation catalyst and the second- and third-stage ebullated bed reactors contain the desulfurization catalyst.

The demetallation catalyst of the present invention comprises a hydrogenation component and a large-pore, high-surface area inorganic oxide support. Suitable demetallation catalysts comprise catalytic amounts of a hydrogenation component selected from the Group VIB metals. In a preferred embodiment, the demetallation catalyst also contains a Group VIII metal. This is especially useful when ebullated bed reactors are employed. In a fixed bed reactor, the activity of the catalyst dissipates over time whereas in the ebullated bed reactor, since fresh amounts of catalyst are continuously added, the Group VIII metal provides increased overall activity. It has been discovered that relatively small amounts of cobalt present in demetallation catalyst provide excellent hydroconversion activity in an ebullated bed system, since fresh amounts are continuously added. This low cobalt hydroconversion-demetallation catalyst is disclosed and claimed in U.S. Ser. No. 811,724.

In any event these metals are deposed on a porous inorganic oxide support such as alumina, aluminum phosphate, or aluminum silicates; suitably, the composition of the demetallation catalyst comprises from about 3.0 to 8.0 wt. % of the Group VIB metal, calculated as the oxide, and optionally from about 0.4 to about 2.0 wt. % of the Group VIII metal, calculated as the oxide, based upon the total weight of the composition. The Group VIB and Group VIII classifications of the Periodic Table of Elements can be found on page 628 of WEBSTER'S SEVENTH NEW COLLEGIATE DICTIONARY, G. & C. Merriam Company, Springfield, Mass., U.S.A. (1965). While calculated as the oxide, the hydrogenation metal components of the catalyst can be present as the element, as an oxide thereof, as a sulfide thereof, or mixture thereof. Molybdenum, which is generally superior to chromium and tungsten in demetallation and desulfurization activity, is a preffered Group VIB metal component in the demetallation catalyst. Cobalt is a preferred Group VIII metal component in the demetallation catalyst.

Preferably, the cobalt is present in an amount of about 0.5 to about 0.8 wt. % and molybdenum is present in an amount of about 3.5 to about 5.0 wt. %.

The demetallation catalyst used in the process of the present invention can be prepared by the typical commercial method of impregnating a large-pore, high-surface area inorganic oxide support. Appropriate commercially available alumina, preferably calcined at about 800°–1,600° F. (426°–872° C.), for about 0.5 to about 10 hours, can be impregnated to provide a suitable firststage catalyst haviing an average pore diameter of about 125 Å to about 295 Å, a surface area ranging from about 150 $m^2/gm$ to about 220 $m^2/gm$, and a total pore volume within the range of about 0.85 cc/gm to about 1.5 cc/gm.

Preferably, the surface area ranges from about 170 $m^2/gm$ to about 200 $m^2/gm$, a total pore volume of about 1.0 cc/gm to about 1.35 cc/gm. The pore volume of pores drawing a diameter greater than 1,200 Å ranges from about 0.1 cc/gm to about 0.40 cc/gm, preferably from about 0.2 $m^2/gm$ to about 0.35 $m^2/gm$. The alumina can be impregnated with a solution, usually aqueous, containing a heat-decomposable compound of the metal to be placed on the catalyst, drying, and calcining the impregnated material. If the impregnation is to be performed with more than one solution, it is understood that the metals may be applied in any order. The drying can be conducted in air at a temperature of about 80° F. (27° C.) to about 350° F. (177° C.) for a period of 1 to 50 hours. Typically, the calcination can be carried out at a temperature of about 800° F. (426° C.) to about 1,200° F. (648° C.) for a period of from 0.5 to 16 hours.

Alternatively, the inorganic oxide support can be prepared by mixing a sol, hydrosol, or hydrogel of the inorganic oxide with a gelling medium, such as ammonium hydroxide followed by constant stirring to produce a gel which is subsequently dryed, pelleted, or extruded, and calcined. The hydrogenation metal can then be incorporated into the support as described above or during the gellation step.

While the demetallation and desulfurization catalyst of the present invention can be present in the form of pellets, spheres, or extrudates, other shapes are also contemplated, such as a clover-leaf shape, cross-shape, or C-shape as disclosed in U.S. Pat. Nos. 3,674,680 and 3,764,565 (Hoekstra, et al.).

The total amount of hydrogenation metals selected from Groups VIB and VIII metals used in the desulfurization catalyst can be present in the catalyst in an amount within the range of about 12 wt. % to about 25 wt. % or greater, calculated as the oxide of the respective metal and based upon the total catalyst weight.

The Group VIB metal is present in an amount ranging from about 10 to about 20 wt. % and the Group VIII metal is present in an amount ranging from 2 to 5 wt. %, both calculated as oxides and based on total catalyst weight.

The Group VIB metal is preferably present in an amount ranging from about 13 to about 15 wt. % and the Group VIII metal is preferably present in an amount ranging from 3.2 to 3.8 wt. %. The preferred Group VIB and Group VIII metals are molybdenum and cobalt respectively.

The finished desulfurization catalyst that is employed in the process of the present invention has a total pore volume within the range of about 0.7 cc/gm to about 1.1 cc/gm, a surface area within the range of about 250 $m^2$ to about 350 $m^2$/gm, and an average pore diameter within the range of about 70 Å to about 135 Å. Preferably, the catalyst possesses a pore volume within the range of about 0.85 cc/gm to about 1.0 cc/gm, and a surface area within the range of about 270 $m^2$/gm to about 310 $m^2$/gm.

In the desulfurization catalyst, those catalyst pores having diameters of 50 Å to 70 Å should contain from about 80 $m^2$/gm to about 120 $m^2$/gm surface area, those having diameters of 70 Å to 150 Å should contain from about 30 $m^2$/gm to 60 $m^2$/gm surface area and those having diameters of 150 to 1,200 Å should have less than 10 $m^2$/gm surface area.

It should be noted that the desulfurization catalyst can be prepared substantially in the same manner elucidated above in connection with the demetallation catalyst and can comprise the same inorganic oxide supports as those used in the demetallation catalyst and any other method known to those skilled in the art.

In both the first reaction zone and the second reaction zone, operating conditions for the hydrotreatment of heavy hydrocarbon streams, such as petroleum hydrocarbon residua and the like, comprise a pressure within the range of about 1,000 psia (68 atmos) to about 3,000 psia (204 atmos), an average catalyst bed temperature within the range of about 700° F. (371° C.) to about 850° F. (454° C.), a liquid hourly space velocity (LHSV) within the range of about 0.1 volume of hydrocarbon per hour per volume of catalyst to about 5 volumes of hydrocarbon per hour per volume of catalyst, and a hydrogen recycle rate or hydrogen addition rate within the range of about 2,000 standard cubic feet per barrel (SCFB) (356 $m^3/m^3$) to about 15,000 SCFB (2,671 $m^3/m^3$). Preferably, the operating conditions comprise a total pressure within the range of about 1,200 psia to about 2,500 psia (81–170 atmos); an average catalyst bed temperature within the range of about 730° F. (387° C.) to about 820° F. (437° C.); and a LHSV within the range of about 0.1 to about 1.0; and a hydrogen recycle rate or hydrogen addition rate within the range of about 5,000 SCFB (890 $m^3/m^3$) to about 10,000 SCFB (1,781 $m^3/m^3$). Generally, the process temperatures and space velocities are selected so that at least 30 vol. % of the feed fraction boiling above 1,000° F. is converted to a product boiling below 1,000° F. and more preferably so that at least 70 vol. % of the subject fraction is converted to a product boiling below 1,000° F.

If the process of the present invention were to be used to treat hydrocarbon distillates, the operating conditions would comprise a hydrogen partial pressure within the range of about 200 psia (13 atmos) to about 3,000 psia (204 atmos); an average catalyst bed temperature within the range of about 600° F. (315° C.) to about 800° F. (426° C.); a LHSV within the range of about 0.4 volume of hydrocarbon per hour per volume of catalyst to about 6 volumes of hydrocarbon per hour per volume of catalyst; and a recycle rate or hydrogen addition rate within the range of about 1,000 SCFB (178 $m^3/m^3$) to about 10,000 SCFB (1,381 $m^3/m^3$). Preferred operating conditions for the hydrotreating of hydrocarbon distillates comprise a hydrogen partial pressure within the range of about 200 psia (13 atmos) to about 1,200 psia (81 atmos); an average catalyst bed temperature within the range of about 600° F. (315° C.) to about 750° F. (398° C.); a LHSV within the range of about 0.5 volume of hydrocarbon per hour per volume of catalyst to about 4 volumes of hydrocarbon per hour per volume of catalyst; and a hydrogen recycle rate or hydrogen addition rate within the range of about 1,000 SCFB (178 $m^3/m^3$) to about 6,000 SCFB (1,068 $m^3/m^3$).

In the reaction zones, catalysts may be employed in the form of a fixed-bed or the preferred ebullated-bed of particles described above. In the case of a fixed-bed, the particulate material catalyst should have a particle size of at least 1/32 to about 1/16 inch (0.08–0.32 cm) effective diameter.

EXAMPLE 1

In the instant example, the process of the present invention was demonstrated with the first-stage catalyst, designated as catalyst A, and the second-stage catalyst, designated as catalyst B. The pertinent catalyst properties for catalysts A and B are set out below in Table I.

TABLE I

| CATALYST PROPERTIES | Catalyst A | Catalyst B |
|---|---|---|
| Surface area ($m^2$/g) | 182 | 320 |
| Total pore volume (cc/g) | 1.3 | 0.86 |
| Pore volume in pores less than 1,200 Å dia. (cc/g) | 0.91 | 0.70 |
| Pore volume in pores greater than 1,200 Å dia. (cc/g) | 0.42 | 0.16 |
| Avg. pore dia. Å ($4V \times 10^4/A$) | 200 | 88 |
| $MoO_3$ (wt. %) | 4.2 | 14.6 |
| CoO (wt. %) | — | 3.6 |
| $SiO_2$ (wt. %) | 3.6 | — |
| $Al_2O_3$ (wt. %) | balance | balance |

The process conditions employed in the present Example and comparative Example 2 are set out below in Table II.

TABLE II

| PROCESS CONDITIONS | Example 1 | | | | | Example 2 | |
|---|---|---|---|---|---|---|---|
| Catalyst | A + B | | | | | B | |
| Days | 1–21 | 22–29 | 30–48 | 49–62 | 1–20 | 21–29 | 30–58 |
| $H_2$ press. (psig) | 2,000 | | | | | 2,000 | |
| $H_2$ flow (cf/h) | 0.5 | 1.0 | 0.5 | 0.5 | 0.5 | 1.0 | 0.5 |
| LHSV ($hr^{-1}$) | 0.2 | 1.0 | 0.2 | 0.2 | 0.2 | 1.0 | 0.2 |
| Temp. (°F.) | 780 | 780 | 780 | 795 | 780 | 780 | 780 |
| Feed | B | A | B | B | B | A | B |

TABLE II-continued

| PROCESS CONDITIONS | | | | | | | |
|---|---|---|---|---|---|---|---|
| | Example | | | | | | |
| Example | 1 | | | | 2 | | |
| Ni + V on catalyst (wt. %) | 5.55 | 21.75 | 26.67 | 30.37 | 4.57 | 21.00 | 27.36 |

The feed compositions are given below in Table III.

TABLE III

| FEED PROPERTIES | | |
|---|---|---|
| Feed number | A | B |
| API gravity | 7.3 | 6.6 |
| C % | 84.40 | 84.78 |
| H % | 10.36 | 10.36 |
| S % | 3.75 | 3.91 |
| N % | 0.62 | 0.47 |
| Ni ppm | 450 | 228 |
| V ppm | 112 | 52 |
| Ramscarbon % | 15.0 | 21.0 |
| Asphaltenes % | — | 12.6 |

The reactor utilized in the present example was first filled with a 9-inch bed of ⅛-inch nonporous ceramic balls topped by 2 inches of 10/14 mesh crushed porous Alundum placed thereon. The tubular reactor had ⅝-inch internal diameter and a 36-inch length. A mixture of 12.5 cc (5.1 gm) of catalyst A plus 12.5 cc of 10/14 mesh crushed porous Alundum was subsequently loaded into the reactor. A mixture of 25 cc (12.7 gm) catalyst B plus 25 cc of 10/14 mesh crushed porous Alundum was then loaded into the reactor. Finally, nonporous ceramic balls and a stainless stell screen were added to fill the reactor.

EXAMPLE 2

A single catalyst system was tested substantially in the same manner and in the identical pilot plant as illustrated above in Example 1 except that 40 cc (20.5 gm) of catalyst B were used as the sole catalyst. The process conditions employed are likewise set out in Table III above.

DISCUSSION OF THE RESULTS

Table IV below sets out the product properties as achieved in processes described in Examples 1 and 2 above:

TABLE IV

| PRODUCT PROPERTIES | | | |
|---|---|---|---|
| | Example | | |
| | 1 | 1 | 2 |
| Catalyst | A + B | A + B | B |
| Days | 30–48 | 49–62 | 30–58 |
| Temp. (°F.) | 780 | 795 | 780 |
| Gravity (°API) | 22.5 | 25.5 | 23.9 |
| Conversion of 1,000° F.+ | 63 | 83 | 75 |
| S (wt. %) | 0.78 | 0.58 | 0.63 |
| Ramscarbon (wt. %) | 7.02 | 4.86 | 5.95 |
| Shell hot filtration solids (wt. %) | 0.63 | 0.81 | 1.18 |

It is noted that the single catalyst B gave a higher quality product at 780° F. than the two catalyst system of the invention except for the amount of Shell hot filtration solids formed (1.18% vs. 0.63%). Unit operability is very difficult when solid levels exceed 1.0 wt. %; therefore, no attempt was made to increase the temperature on the run with the single catalyst. However, with the two catalyst system of the present invention, solids were only at a 0.59 wt. % level and the temperature was raised to 795° F. for days 49 through 62. At these conditions solids increased to 0.81 wt. %, still significantly below the 1.16 wt. % solids produced by the single catalyst system when operating at 780° F. For the two catalyst system at 795° F. conversion of the 1,000° F. plus material increased to 80% and Ramscarbon was reduced to 4.86%. Thus, the two catalyst system of the present invention can be operated at a higher temperature which gives higher conversion and a higher quality product than can be obtained with the single catalyst system which is substantially more expensive.

EXAMPLE 3

The present example is included to demonstrate the advantages associated with the present invention as compared to a system utilizing only the second-stage desulfurization catalyst and a system using the prior art two-stage process such as disclosed in U.S. Pat. Nos. 4,212,729 and 4,297,242 wherein the desulfurization catalyst does not possess any macropores.

FIG. 1 plots the Shell hot filtration solids as a function of percentage conversion of material boiling over 1,000° F. to material boiling below 1,000° F. for the process of the invention, a process utilizing only a desulfurization catalyst, i.e. the desulfurization catalyst of the present invention designated as, "comparative bimodal" and the prior art two-stage process wherein the desulfurization catalyst possesses no macropores designated as "comparative monomodal." The following Table V sets out the catalyst properties of the prior art two-stage process:

TABLE V

| CATALYST PROPERTIES | | |
|---|---|---|
| | Stage 1 | Stage 2 |
| Surface area ($m^2/g$ | 172 | 189 |
| Total pore volume (cc/g) | 1.06 | 0.64 |
| Pore volume in pores less than 1,200 Å dia. (cc/g) | 0.98 | 0.64 |
| Pore volume in pores greater than 1,200 Å dia. (cc/g) | 0.08 | 0 |
| Average pore dia. Å ($4 V \times 10^4/A$) | 229 | 135 |
| $P_2O_5$ (wt. %) | 11.3 | 0 |
| $MoO_3$ (wt. %) | 4.1 | 10.3 |
| $SiO_2$ (wt. %) | 0.7 | 0 |
| $Al_2O_3$ (wt. %) | balance | balance |

As can be observed from FIG. 1, the prior stage process produces substantially more solids than the process of the invention, thereby impairing operability of the system. The process of invention as demonstrated above possesses a cost advantage over the use of a system containing only the expensive desulfurization catalyst since the invention demetallation catalyst is less expensive than the desulfurization catalyst that it supplants in the process of the invention. The conditions used in the present example for testing the prior art two stage process are set out below in Table VI.

TABLE VI

| PROCESS CONDITIONS | Days | |
|---|---|---|
| | 121–124 | 125–126 |
| Pressure, psig | 2700 | 2700 |
| Temperature, °F. | 761 | 776 |
| Space velocity, V/V | .19 | .19 |
| $H_2$ rate, SCFB | 4300 | 5000 |
| % (Ni + V + Fe) on catalyst | 14.9 | 15.2 |

The properties of the feedstock used in testing the prior art two stage process in the present example are set out below in Table VII.

TABLE VII

| FEEDSTOCK PROPERTIES | |
|---|---|
| API Gravity, ° | 6.3 |
| Carbon, wt. % | 84.12 |
| Hydrogen, wt. % | 10.18 |
| Nitrogen, wt. % | 0.40 |
| Sulfur, wt. % | 5.15 |
| Nickel, ppm | 43 |
| Vanadium, ppm | 146 |
| Ramscarbon, wt. % | 20.8 |
| 1000° F. +, wt. % | 8.0 |

Figure 2:
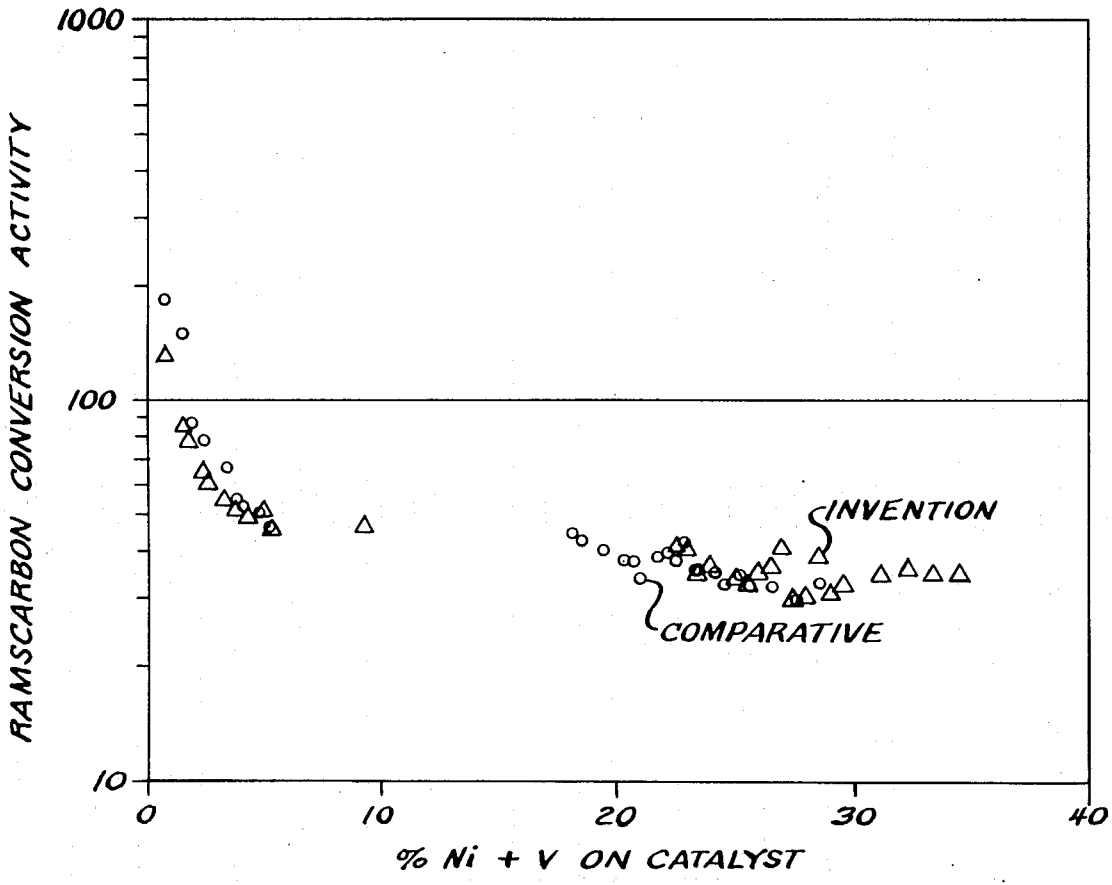
FIGS. 2–3 illustrate the RAMS activity and hydrodesulfurization activity, respectively, of the process of the invention as compared to a process utilizing only a desulfurization catalyst.
Figure 3:
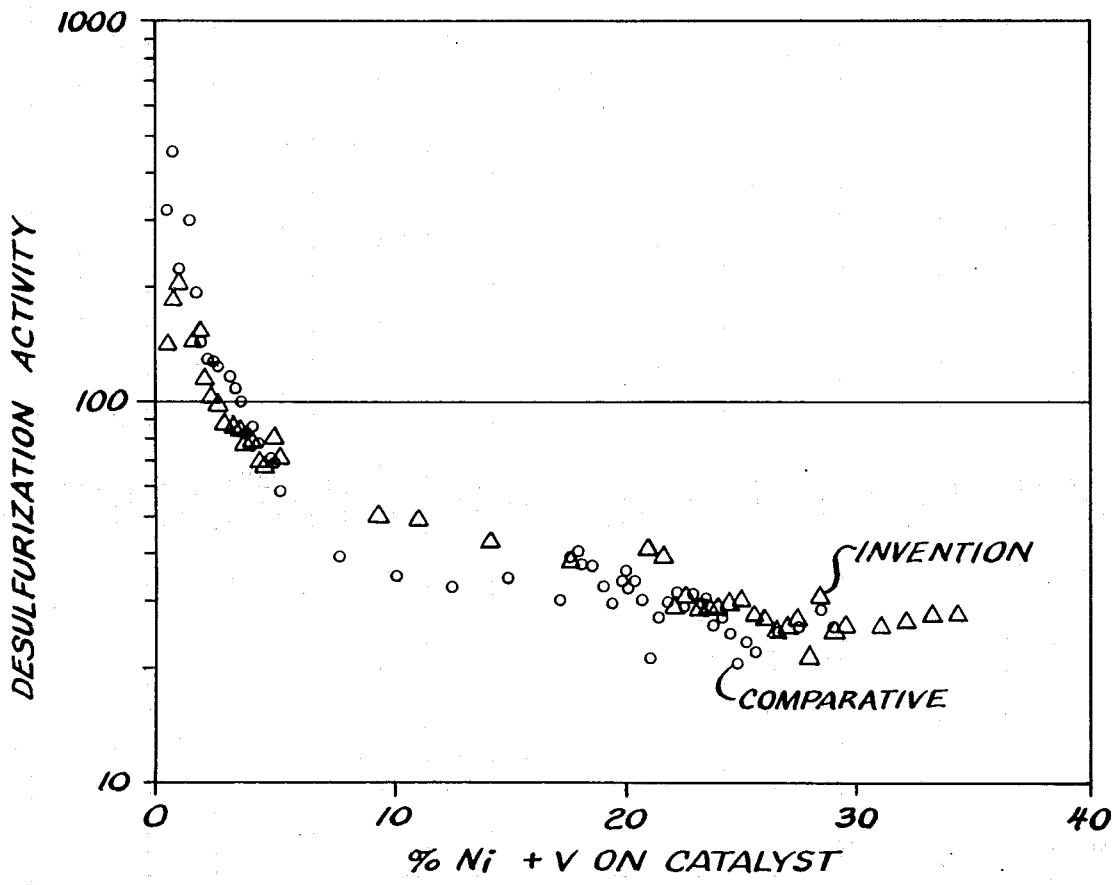

FIGS. 2 and 3 are provided to show that the process of the invention does not suffer any deficiencies with respect to RAMS carbon activity and hydrodesulfurization activity as compared a process utilizing only the invention desulfurization catalyst. These Ramscarbon and hydrodesulfurization activities were calculated using pseudo-second order plug flow kinetics. As is readily evident from the figures, the process of the invention suffers no deficiencies with respect to RAMS carbon conversion and hydrodesulfurization, but offers the advantages of less expense and improved operability.

What is claimed is:

1. A process for the hydrodemetallation, hydrodesulfurization, and hydrocracking of a hydrocarbon feedstock containing asphaltenes, metals, and Shell hot filtration solids precursors and the conversion of at least 30 vol. % of the feedstock fraction boiling over 1,000° F. to material boiling below 1,000° F. which comprises:

(a) contacting said feedstock in a first reaction zone with hydrogen and a demetallation catalyst comprising a Group VIB hydrogenation metal component on a porous inorganic oxide support, wherein said Group VIB metal is present in an amount rangin from about 3.0 to about 8.0 wt. % calculated as an oxide and based on total demetallation catalyst weight, and wherein said catalyst has a surface area of about 150 $m^2$/gm to about 220 $m^2$/gm; a total pore volume of about 0.85 to about 1.5 cc/gm; and a pore volume in pores having diameters larger than 1,200 Å of about 0.15 to about 0.4 cc/gm; and (b) contacting the effluent from said first reaction zone in a second reaction zone with a desulfurization catalyst comprrsing a hydrogenation metal component comprising a Group VIB metal and a Group VIII metal on a porous inorganic oxide support, wherein said Group VIB metal is present in an amount ranging from about 10.0 to about 20.0 wt. % calculated as an oxide and based on total desulfurization catalyst weight, and said Group VIII metal is present in an amount ranging from about 2.0 to about 5.0 wt. % calculated as an oxide and based on total desulfurization catalyst weight, and wherein said catalyst has a surface area of about 250 $m^2$/gm to about 350 $m^2$/gm, a total pore volume of about 0.7 to about 1.1 cc/gm and a pore volume in pores having diameters larger than 1,200 Å of about 0.1 to about 0.25 cc/gm.

2. The process of claim 1 wherein said demetallation catalyst and said desulfurization catalyst comprise an inorganic oxide selected from the group consisting of alumnia, aluminum silicate, and aluminum phosphate.

3. The process of claim 1 wherein said Group VIB metal is molybdenum and said Group VIII metal is cobalt.

4. The process of claim 1 wherein said demetallation catalyst is present in an amount ranging from about 0.2 volumes to about 0.6 volumes and said desulfurization catalyst is present in an amount ranging from about 0.4 volumes to about 0.8 volumes.

5. The process of claim 1 wherein said contacting with said demetallation catalyst and said contacting with said desulfurization catalyst is carried out in a series of ebullated bed reactors.

6. The process of claim 1 wherein at least 70 vol. % of the fraction of the hydrocarbon feedstock boiling above 1,000° F. is converted to a material boiling below 1,000° F.

7. The process of claim 1 wherein said Group VIB hydrogenation metal component in said demetallation catalyst is present in an amount ranging from about 3.5 to about 5.0 wt. % calculated as an oxide based on total demetallation catalyst weight and wherein the Group VIB metal present in said desulfurization catalyst is present in an amount ranging from about 13 to about 15 wt. % calculated as an oxide and based on total desulfurization catalyst weight and wherein the Group VIII metal present in said desulfurization catalyst is present in an amount ranging from about 3.2 to about 3.8 wt. % calculated as an oxide and based on total desulfurization catalyst weight.

8. The process of claim 1 wherein said demetallation catalyst also contains a Group VIII hydrogenation metal component wherein the Group VIII metal component is present in an amount ranging from about 0.4 to about 2.0 wt. % calculated as an oxide and based on total demetallation catalyst weight.

9. The process of claim 8 wherein said demetallation catalyst and said desulfurization catalyst comprise an inorganic oxide selected from the group consisting of alumnia, aluminum silicate, and aluminum phosphate.

10. The process of claim 8 wherein said Group VIB metal is molybdenum and said Group VIII metal is cobalt.

11. The process of claim 8 wherein said demetallation catalyst is present in an amount ranging from about 0.2 volumes to about 0.6 volumes and said desulfurization catalyst is present in an amount ranging from about 0.4 volumes to about 0.8 volumes.

12. The process of claim 8 wherein said contacting with said demetallation catalyst and said contacting with said desulfurization catalyst is carried out in a series of ebullated bed reactors.

13. The process of claim 8 wherein at least 70 vol. % of the fraction of the hydrocarbon feedstock boiling above 1,000° F. is converted to a material boiling below 1,000° F.

14. The process of claim 8 wherein said Group VIB hydrogenation metal component in said demetallation catalyst is present in an amount ranging from about 3.5 to about 5.0 wt. % calculated as an oxide based on total demetallation catalyst weight and wherein said Group VIII metal is present in an amount ranging from about 0.5 to about 0.8 wt. % calculated as an oxide and based on total demetallation catalyst weight and wherein the Group VIB metal present in said desulfurization catalyst is present in an amount ranging from about 13 to about 15 wt. % calculated an an oxide and based on total desulfurization catalyst weight and wherein the Group VIII metal present in said desulfurization catalyst is present in an amount ranging from about 3.2 to about 3.8 wt. %.

* * * * *